US008701789B2

(12) United States Patent
Kruger et al.

(10) Patent No.: US 8,701,789 B2
(45) Date of Patent: Apr. 22, 2014

(54) METHOD AND ARRANGEMENT FOR PRODUCING COMPRESSED AIR FOAM FOR FIRE-FIGHTING AND DECONTAMINATION

(75) Inventors: Tino Kruger, Jüterbog (DE); Gunther Dorau, Potsdam (DE)

(73) Assignee: Sogepi S.A., Geneva (CH)

( * ) Notice: Subject to any disclaimer, the term of this patent is extended or adjusted under 35 U.S.C. 154(b) by 917 days.

(21) Appl. No.: 11/578,682

(22) PCT Filed: May 19, 2005

(86) PCT No.: PCT/DE2005/000959

§ 371 (c)(1),
(2), (4) Date: Oct. 17, 2006

(87) PCT Pub. No.: WO2006/000177

PCT Pub. Date: Jan. 5, 2006

(65) Prior Publication Data

US 2007/0209807 A1 Sep. 13, 2007

(30) Foreign Application Priority Data

Jun. 28, 2004 (DE) ..... 10 2004 032 020

(51) Int. Cl.
*A62C 2/00* (2006.01)

(52) U.S. Cl.
USPC ..... 169/44; 169/15; 169/43; 169/46; 239/310; 239/422; 239/428

(58) Field of Classification Search
USPC ..... 169/14, 15, 43, 44, 26, 27, 46, 47; 239/61, 407, 427, 427.3, 310, 318, 239/422, 428
See application file for complete search history.

(56) References Cited

U.S. PATENT DOCUMENTS

| | | | | | |
|---|---|---|---|---|---|
| 4,234,044 | A * | 11/1980 | Hollan et al. | 169/14 |
| 4,474,680 | A * | 10/1984 | Kroll | 516/10 |
| 4,899,825 | A * | 2/1990 | Bosoni et al. | 169/14 |
| 5,086,846 | A * | 2/1992 | Carlson | 169/15 |
| 5,240,179 | A * | 8/1993 | Drinkwater | 237/80 |
| 5,255,747 | A | 10/1993 | Teske et al. | |
| 5,291,951 | A * | 3/1994 | Morand | 169/14 |
| 5,411,100 | A | 5/1995 | Laskaris et al. | |
| 6,109,359 | A * | 8/2000 | Ballard | 169/14 |
| 6,263,974 | B1 * | 7/2001 | Sundholm | 169/62 |
| 6,725,940 | B1 * | 4/2004 | Klein et al. | 169/15 |
| 6,733,004 | B2 * | 5/2004 | Crawley | 261/18.1 |
| 6,766,863 | B2 * | 7/2004 | Arvidson et al. | 169/14 |
| 6,973,975 | B1 * | 12/2005 | Adamson et al. | 169/24 |
| 7,389,824 | B2 * | 6/2008 | Jackson | 169/16 |
| 2003/0164465 | A1 * | 9/2003 | Bureaux et al. | 252/3 |
| 2004/0020664 | A1 | 2/2004 | Juidici et al. | |

* cited by examiner

*Primary Examiner* — Steven J Ganey
(74) *Attorney, Agent, or Firm* — The Webb Law Firm

(57) ABSTRACT

The invention relates to a compressed air foam producer, wherein a fire or decontamination specific additive is injected directly into the foam forming flow supplied to the main water flow and/or the main water flow. A mixing pump for the foaming agent draws off an auxiliary and motive water flow, wherein initially the additive and then the foaming agent is injected. The foaming agent-additive-water mixture, which is produced directly on site, is mixed well together and with the main water flow ensuring a fine, uniform distribution of the additives in the compressed air foam. The thus produced compressed air foam ensures optimal, economical and environmentally friendly fire-fighting and decontamination.

13 Claims, 2 Drawing Sheets

METHOD AND ARRANGEMENT FOR PRODUCING COMPRESSED AIR FOAM FOR FIRE-FIGHTING AND DECONTAMINATION

BACKGROUND OF THE INVENTION

1. Field of the Invention

This invention relates to a method of producing compressed air foam (CAF) for fire fighting and decontamination in which a main water stream is mixed with a foaming agent stream and the mixture of water and foaming agent is foamed along a foaming line with a compressed air stream, and further relates to an arrangement for performing the method.

2. Description of Related Art

The generation of CAF alone in the way described above is known. When this document mentions CAF production with compressed air, the term 'compressed air' is of course meant to include pressurized gases suitable for fire extinction. Fire fighting and decontamination of objects with CAF has proved its worth in many application cases. Formulated application-specific mixtures of foaming agents and specific additives are provided to be able to use the CAF as optimally and efficiently as possible for the respective type of fire or contamination with as little environmental impact as possible. The production and provision of such mixtures is limited inasmuch as foaming agents with specific additives adjusted to the respective type of fire or decontamination often dissolve with difficulty or not at all in the stock solution, result in high-viscosity mixtures or tend to clot, which makes them hard to deliver or distribute evenly their full effect. Apart from difficulties in the production or provision and processing of mixtures with the most varied additives, it is also not feasible to keep a multitude of mixtures or even a mixture of the same components in different compositions available at the respective set and for the respective application case, for example to enable optimum fire fighting using variable portions of additives.

SUMMARY OF THE INVENTION

It is therefore the object of the invention to state a method of producing compressed air foam (CAF) that ensures high efficiency in terms of its effectiveness, quantity of agents used, and environmental impact in different applications and conditions of use depending on the type of the fire or decontamination as well as a plant for performing this method with as little hardware use as possible.

This problem is solved according to the invention by the method and apparatus disclosed herein.

The inventive idea, in other words, is that during the production of the CAF, i.e. directly on the application site, at least one specific additive adjusted to the respective type of fire or the respective decontamination purpose is admixed to a stream of foaming agent that is added to the main water stream or directly to the main water stream and ensures an optimum effect of the CAF with regard to fast and safe fire fighting or decontamination. It was found that the addition of just one special additive is sufficient and that it is especially the accurately dosed separate feeding of the additive into the foaming agent stream that ensures thorough mixing in the foaming agent and particularly a uniform, fine distribution in the fire extinguishing or decontamination foam resulting in maximum effectiveness of the additive combined with low consumption and reduced environmental pollution. In particular, various types of fires and various and differently contaminated objects can be fought or decontaminated effectively.

DESCRIPTION OF THE PREFERRED EMBODIMENTS

Figure 1:
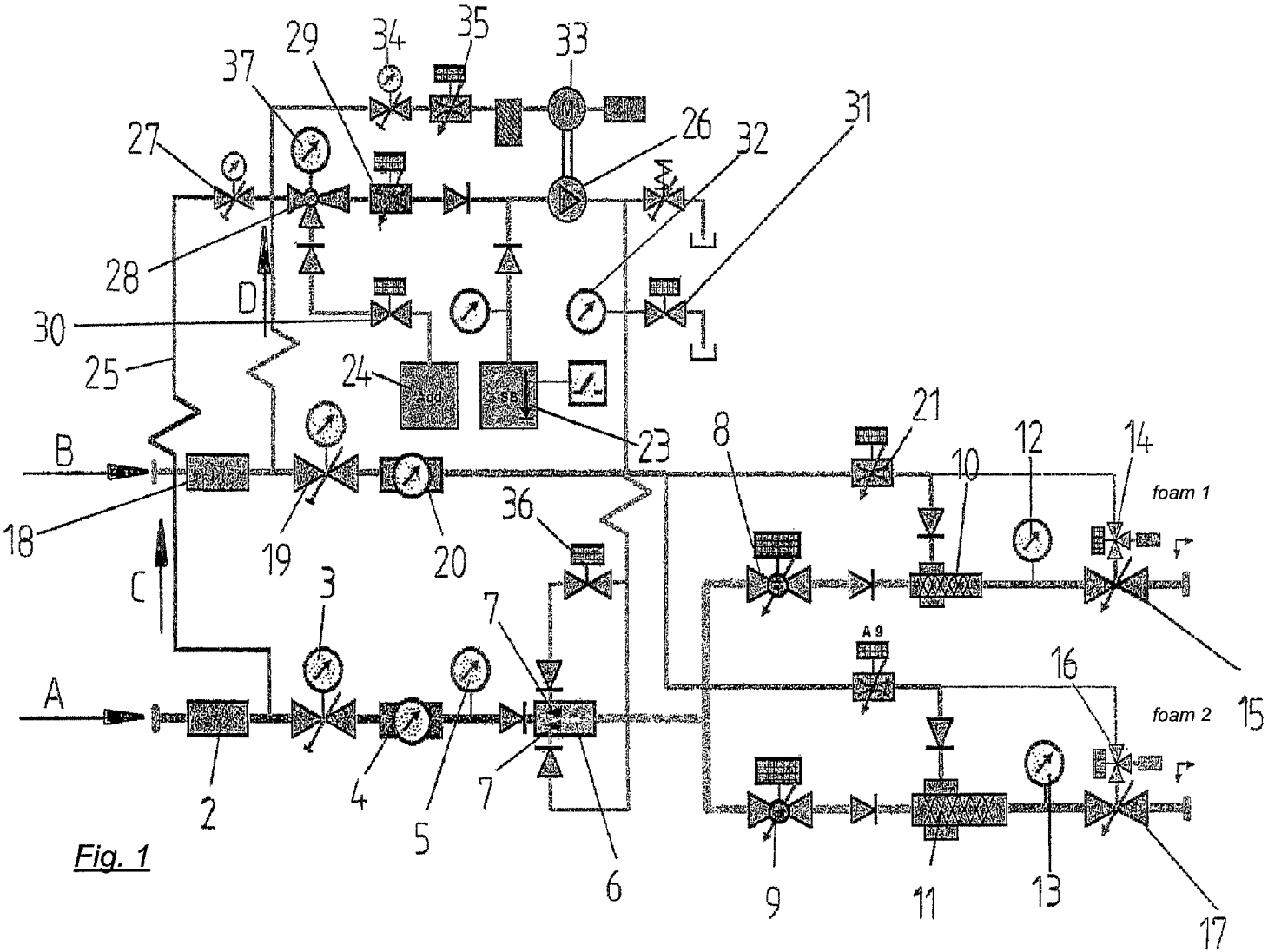
FIG. 1 is a schematic diagram of a system for producing a two-component foam in two foaming lines having different foaming capacities.
Figure 2:
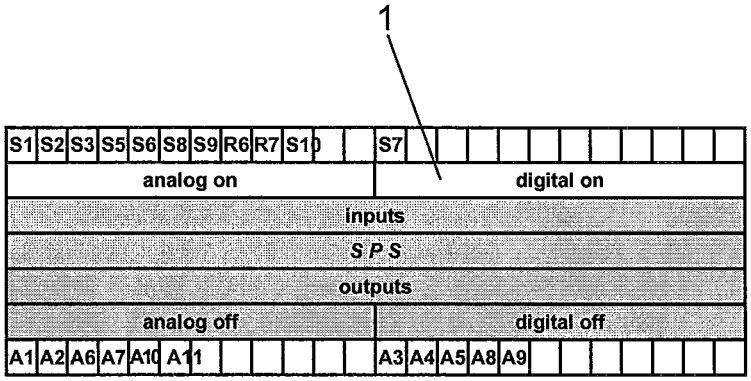
FIG. 2 is a representation of a programmable logic controller with digital and analog electric inputs and outputs.

In a preferred improvement of the method according to the invention, the additive is first injected into an auxiliary and motive water stream by aspirating the respective additive based on the water jet pump principle while an auxiliary and motive water stream for the fire extinguishing or decontaminating agent is produced by suctioning off the main water stream using the same admixing pump that also aspirates the foaming agent from a tank for foaming agent. The introduction of the additive and the foaming agent into a water jet already provides good premixing and finally ensures even distribution in the main water stream.

In another embodiment of the invention, foaming agent and additive are admixed at different mixing ratios depending on a pressure and water volume control system of the auxiliary and motive water stream in conjunction with the adjustable admixing pump speed. It is of course possible to just introduce the foaming agent or the respective additive or none of the two into the main water stream.

In an embodiment of the method, the auxiliary or motive water stream can be used to introduce an antifreeze or rinsing agent instead of an additive into the system.

In another embodiment, the foam pressure and thus the quality of the CAF produced with the additive and the foaming agent can be influenced by modifying the foaming period using a valve arrangement.

The arrangement according to the invention for performing the method, for the case where an additive is admixed to the foaming agent, includes a mixer that is integrated into the main water stream in which the main water stream is intermixed with the additive-water-foaming agent mixture. An additive container that is in a functional connection with the admixing pump is provided for intermixing the foaming agent aspirated with the admixing pump and the respective additive. The admixing pump is connected to the main water stream to provide the auxiliary and motive water stream via a bypass line to which first a Venturi admixer and then the foaming agent tank are connected in the direction of flow. The admixing pump is preferably driven by a pneumatic motor that takes the required driving air from the main air stream for compressed air foaming and can be controlled using an air pressure and air volume controller. A speed-controlled DC motor to which the zero shift of non-stall-resistant motors described below can be applied and can be used instead of the pneumatic motor. A pressure sensor is associated with an upstream water pressure controller and a downstream water volume flowrate control unit are connected to the Venturi admixer. The required quantities of foaming agent and additive can be set by a controller using the respective pressure conditions and volume flowrates. The mixer is provided with two injection nozzles with different k values to introduce differing quantities of foaming agent-additive mixture into the main water stream.

The arrangement according to the invention can be used to provide compressed air foams using the method described above that contain an additive admixed in situ at different quantities depending on the respective application case, i.e.

the type of fire or decontamination, and evenly distributed in the foam so that these foams enable efficient fire fighting and decontamination. The system is of a very simple design as it uses compressed air and water as energy sources for operating the admixing system which are required anyway for producing the CAF. While the foaming agents are generally the same, all that is needed to be held in stock are different additives that are finely and evenly admixed into, and distributed in, the foaming agent without demixing or clotting and contained in the same even distribution in the fire extinguishing or decontaminating foam so that they can unfold their full effect.

One embodiment of the invention is explained in more detail with reference to FIG. 1 that shows the schematic diagram of a system for producing a two-component foam in two foaming lines having different foaming capacities.

A programmable logic controller 1 with digital and analog electric inputs and outputs that cooperates with the system-specific sensors and control valves is assigned to the system for monitoring and control. The arrows A, B, C, and D represent the main water stream, the main airstream, the auxiliary and motive water stream, and the drive air stream, respectively.

Water is fed into the system from a fire extinguishing pump or pressurized-water reservoir (not shown) and flows via a water filter 2, a water pressure controller 3, a water volume flowrate control unit 4, and a water pressure sensor 5 into a mixer 6. Two injection nozzles 7 with different k values lead into the mixer 6 via which injection nozzles 7 a mixture of a commercial foaming agent (SB) and an application-specific second component (Add) depending on the current fire fighting or decontaminating requirements is fed into the water volume flow. The water volume flow intermixed with the two components (foaming agent and additive) flows via first and second water flowrate control valves 8 or 9, respectively, into a first or second foaming line 10 and 11 in which the respective water mixture is foamed using compressed air. The first or second, respectively, compressed air foam produced in this way flows via foam pressure sensors 12 or 13 and electro-pneumatically operated valves 14, 15 or 16, 17, respectively, that form a closed-loop control circuit for setting the foam consistency and consequently, the foam quality to the respective foam ejection device (not shown). Compressed air is conducted into the foaming lines 10, 11 from a compressed air source or a compressor (not shown) via an air filter 18, an air pressure controller 19, an air pressure sensor 20 and respective first and second air volume flowrate control valves 21 located upstream of respective the foaming lines 10, 11.

As mentioned above, a foaming agent and an additive adjusted to the respective application case with which the fire can be fought in a controlled manner and more efficiently than before are injected into the water volume flow using the mixer 6. The substances are admixed from a foaming agent tank 23 and an additive container 24 that was filled before use with an additive that is adjusted to the type of fire or substances to be decontaminated and highly effective but cannot be mixed durably and homogeneously with the foaming agent. The foaming agent tank 23 and the additive container 24 are connected to a bypass line 25 that branches off from the overall water flow downstream of the water filter 2 and runs into the injection nozzles 7 of the mixer 6 at its other end. An admixing pump 26 with upstream water pressure controller 27, a Venturi admixer 28 and a water flowrate control unit 29 is inserted into the bypass line 25. The additive container 24 is connected to the Venturi admixer 28 via a valve 30, and a delivery line from the foaming agent tank 23 runs directly into the bypass line 25 upstream of the admixing pump 26. A valve 31 for flushing and bleeding the admixing pump 26 and a flow meter 32 are integrated into the portion of the bypass line 25 that is located between the mixer 6 and the admixing pump 26. The admixing pump 26 is driven by a pneumatic motor 33 that is connected to the compressed air feed line behind the air filter 18 via an air pressure controller 34 for setting the operating pressure and an air volume flowrate control valve 35 for controlling the motor speed.

The foaming agent with additive fed via the bypass line 25 is injected into the water volume flow delivered by the mixer 6. The foaming agent-additive-water mixture flows via the water volume flowrate control valves 8 and/or 9 and the compressed air foam generators 10 and/or 11 into which compressed air is inserted at preset pressure and volume parameters via the air volume flowrate control valves 21 and/or 22. The foam quality of the compressed air foam spread using foam ejecting devices (not shown) depends on the flow rate and therefore on the dwell time of the foam in the foaming lines 10, 11 and is controlled via the foam pressure determined by the foam pressure sensors 12, 13 using valves 14, 15 or 16, 17, respectively (foam pressure control).

The speed of the pneumatic motor 33 of the admixing pump 26 is controlled by the air volume flowrate control valve 35. The controller 1 determines the setpoint control signal for the motor speed in conjunction with the pump characteristic from the setpoint value preset for the foaming agent-additive admixing rate and the actual value determined by the water volume flow sensor 4. In the embodiment shown here—without using a flow meter for the foaming agent—the pressure difference between the initial pressure at the admixing pump 26 and the flow pressure of the water at the inlet of the mixer 6 is measured using the water pressure sensor 5 and the pressure sensor 32. The foaming agent-additive mixture is injected into the water stream via the injection nozzles 7. The volume flows through the respective injection nozzle 7 as a function of the differential pressure are stored as a parameter table in the controller 1. The admixture of foaming agent and additive is controlled depending on pressure using the setpoint values preset in comparison with the water volume flow determined by the water flow sensor 4, the speed control of the admixing pump 26, the differential pressure measurement mentioned above, and the parameter tables stored in the controller 1. To ensure as small pressure-volume flow curves as possible, smaller volume flows or volume flows defined in specific limits are admixed using an injection nozzle 7 with a small k value while a second injection nozzle 7 with a larger k value is connected via the valve 36 for larger volume flows, thereby ensuring a maximum volume flow for admixing the foaming agent-additive mixture.

According to the embodiment discussed here, volume flowrate control valves 8, 9 for the water-foaming agent-additive mixture and air volume flowrate control valves 21, 22 are inserted upstream of the respective CAF generator 10, 11 to be able to provide even very small volume flows, especially when decontaminating.

The foaming agent and the other specific component depending on the respective type of fire or decontamination job are admixed using the admixing pump 26 which is driven by a pneumatic motor 33 speed-controllable to adjust capacity using the air volume flowrate control valve 35. Water is aspirated through the bypass line connected to the main water stream via the water pressure controller 27 and the Venturi mixer as well as the water volume flowrate control unit 29 using the admixing pump 26.

As the pneumatic motors, mostly designed as compressed air rotating piston type motors, are not stall-resistant at a specific speed, i.e. stall at slow speeds and high torques, which means that major mechanical damage is prevented in case of failure but that the admixing pumps cannot continuously be driven from standstill to maximum speed, a defined water volume flow of a size which the admixing pump 26 would deliver at the stalling torque or stalling speed of the pneumatic motor 33 is injected into the bypass line on the inlet side of the admixing pump 26 via the water pressure controller 27 and the water volume flowrate control unit 29. The admixing pump 26 must rotate at stalling speed for the injected water volume flow to flow. When the speed is increased, foaming agent is aspirated from the foaming agent tank 23 at the desired quantity (between zero and a maximum) in proportion to the speed due to the limited water volume flow injected. The injected water volume flow prevents the admixing pump from running dry and supports the aspiration process when aspirating the foaming agent. If no additive is to be aspirated as fire- or decontamination-specific component, the auxiliary water flow can be shut down by closing the water volume flowrate control unit 29, and the entire capacity of the admixing pump 26 can be used for delivering foaming agent. The zero shift caused with the arrangement described above of the non-stall-resistant pneumatic motor 33 can similarly be used for speed-controlled DC motors applied instead of the pneumatic motor.

The second component that is—if necessary—to be admixed to the foaming agent is aspirated, with the valve 30 open, from the additive container 24 in proportion to the differential pressure via the auxiliary water stream mentioned above that flows through the Venturi admixer 28 at a pressure set by the water pressure controller 27 and while reducing the differential pressure using the water volume flowrate control unit 29 and intensely intermixed with the auxiliary water stream if the speed of the admixing pump 26 is increased using the air volume flowrate control unit at the same time. At increased pump speed and simultaneously constant differential pressure, the admixing pump 26 aspirates foaming agent from the foaming agent tank 23 via the Venturi admixer 28 together with the auxiliary water stream and the additive while both partial streams are intensely intermixed.

Thus an additive suitable for the specific application case can be added to the main water stream together with a foaming agent in the mixer 6 enabling highly controlled and effective fire fighting or decontamination. The foaming agent and the additive may be mixed at variable ratios in the quantities required. The foaming agent and the additive can also be the sole admixed substances: the foaming agent can be admixed solely in quantities from zero to a maximum related to the delivery volume of the admixing pump 26, the additive up to the 1.6-fold of the auxiliary and motive water stream flowing through the Venturi admixer 28.

The invention claimed is:

1. A method for producing compressed air foam (CAF) for fire fighting and for decontamination comprising the steps of:

providing a main water stream;

producing a foaming agent stream by a pneumatically or electrically operated admixing pump that is connected to a foaming agent reservoir, wherein producing the foaming agent stream comprises:

first aspirating a separate auxiliary and motive water stream from the main water stream, such that the separate auxiliary and motive water stream is injected into the admixing pump;

then, suctioning an additive off a separate reservoir by the auxiliary and motive water stream, wherein the additive is adjusted to an application case and specific to the type of fire or decontamination; and suctioning the foaming agent into the additive-water mixture, wherein, the additive is suctioned into the auxiliary and motive water stream first, followed by the foaming agent;

mixing, after the step of producing a foaming agent stream, the auxiliary and motive water stream, including the additive and foaming agent, with the main water stream; and loading the combined foaming agent and main stream, after the step of mixing, with a compressed air stream at a foaming line.

2. The method according to claim 1, wherein the step of mixing the auxiliary and motive water stream, including the additive and foaming agent, with the main water stream includes injecting the foaming agent and the additive at variable mixing ratios into the main water stream.

3. The method according to claim 2, further comprising the step of setting the auxiliary and motive water stream via a pressure and water volume flowrate control system using the pump speed of the admixing pump so that the foaming agent and additive in the auxiliary and motive water stream are intermixed in variable compositions depending on the differential pressure measured for the additive using a Venturi admixer and the speed of the admixing pump.

4. The method according to claim 1, wherein either only the foaming agent at quantities varying in relation to the delivery capacity of the admixing pump or only the additive is admixed to the main water stream together with the auxiliary and motive water stream.

5. The method according to claim 1, further comprising the step of providing an antifreeze or rinsing agent is instead of the additive.

6. The method according to claim 1, further comprising the step of adjusting the foam quality of the CAF formed from the foaming agent and the additive by regulating the foam pressure with valves to control the flow rate or dwell time though the foaming line of the foam generator.

7. An arrangement for performing the method according to claim 1, comprising a mixer for a foaming agent integrated into the main water stream, and a foaming line through which the water-foaming agent mixture flows and into which a main compressed air stream runs for foaming the water-foaming agent mixture, as well as an admixing pump driven by a pneumatic motor or speed-controlled DC motor for aspirating the foaming agent from a foaming agent tank and introducing it into the mixer, wherein an additive container filled with an additive that is specific to the respective type of fire or goal of decontamination is also connected to said admixing pump.

8. The arrangement according to claim 7, wherein, when the additive is admixed to the foaming agent stream, the admixing pump is connected to the main water stream (A) via a bypass line and an auxiliary and motive water stream (C) runs through it, and wherein the foaming agent tank via a Venturi admixer and the additive container are connected to the bypass line; and wherein a pressure sensor is assigned to the Venturi admixer and a water pressure controller is inserted upstream and a water volume flowrate control unit is inserted downstream of the Venturi admixer; and a pneumatic motor driving the admixing pump is connected to the main air stream (B) for providing a driving air stream (D), and that an air pressure controller and an air volume flowrate control unit are integrated into a feed line for the driving air stream (D).

9. The arrangement according to claim 8, wherein a valve for shutting the connecting line off is integrated into a connecting line between the Venturi admixer and the additive container.

10. The arrangement according to claim 8, wherein a pressure sensor and a valve connected with a collecting basin are inserted in the connecting line between the admixing pump and the mixer.

11. The arrangement according to claim 8, wherein at least two injection nozzles with different k values connected to the connecting line with the admixing pump are associated with the mixer, and wherein a valve is placed upstream of the injection nozzle with the greater k value.

12. The arrangement according to claim 7, wherein a foam pressure sensor and a valve arrangement for foam pressure adjustment are placed downstream of the CAF generator.

13. The method according to claim 1, wherein the step of aspirating the auxiliary and motive water stream into the admixing pump comprises injecting a constant flow rate of water at intake of the admixing pump so that the quantity of foaming agent aspirated from the foaming agent tank into the admixing pump depends on the speed of the admixing pump.

* * * * *

UNITED STATES PATENT AND TRADEMARK OFFICE

CERTIFICATE OF CORRECTION

PATENT NO. : 8,701,789 B2
APPLICATION NO. : 11/578682
DATED : April 22, 2014
INVENTOR(S) : Kruger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1050 days.

Signed and Sealed this
Twenty-ninth Day of September, 2015

Michelle K. Lee

Michelle K. Lee
*Director of the United States Patent and Trademark Office*